United States Patent [19]

Rose, Jr.

[11] 4,390,069

[45] Jun. 28, 1983

[54] TRIFLUOROBROMOMETHANE FOAM FIRE FIGHTING SYSTEM

[75] Inventor: George R. Rose, Jr., East Patchogue, N.Y.

[73] Assignee: Grumman Aerospace Corporation, Bethpage, N.Y.

[21] Appl. No.: 280,693

[22] Filed: Jul. 6, 1981

Related U.S. Application Data

[63] Continuation of Ser. No. 80,446, Oct. 1, 1979, abandoned.

[51] Int. Cl.[3] ..... A62C 35/02; A62C 5/04

[52] U.S. Cl. ..... 169/15; 239/428.5; 252/3

[58] Field of Search ..... 169/14, 15, 46, 47; 252/3, 4, 8.05; 239/428.5

[56] References Cited

U.S. PATENT DOCUMENTS

| | | | |
|---|---|---|---|
| 1,829,714 | 2/1931 | McElroy et al. . | |
| 2,860,856 | 11/1958 | Bauer | 169/14 X |
| 3,234,962 | 2/1966 | Williamson | 169/14 X |
| 3,529,670 | 9/1970 | Herbline . | |
| 3,609,074 | 9/1971 | Rainaldi et al. | 252/3 |
| 3,656,553 | 4/1972 | Rainaldi et al. | 252/3 X |
| 3,701,482 | 10/1972 | Sachnik | 169/15 X |
| 3,849,315 | 11/1974 | Chiesa, Jr. | 252/3 |
| 4,037,664 | 7/1977 | Gibson | 169/15 |
| 4,038,195 | 7/1977 | Chiesa, Jr. | 252/3 |
| 4,042,522 | 8/1977 | Falk | 252/8.05 |
| 4,069,158 | 1/1978 | Bertocchio et al. | 252/3 |
| 4,069,872 | 1/1978 | Lassen | 252/3 X |

*Primary Examiner*—Fred Silverberg
*Attorney, Agent, or Firm*—Richard G. Geib

[57] ABSTRACT

An apparatus for use in foam-type fire-fighting equipment in which a halogenated hydrocarbon (halogen), preferably trifluorobromomethane, $CF_3Br$, is injected into the fire extinguishing agent to improve the efficiency thereof. In several embodiments in which a foam nozzle or a foam generator is employed, the halogen is metered at a prescribed rate into the foam or foam liquid to entrain halogen into the bubbles of the foam such that the bursting of the bubbles due to the effects of the fire release the halogen to act on the fire. In further embodiments, a foam for fighting fires is produced with a plain hose nozzle by injecting the halogen into the fire extinguishing agent, the bubbles of the foam having halogen entrained therein that is released when the foam is used to blanket a fire.

1 Claim, 5 Drawing Figures

TRIFLUOROBROMOMETHANE FOAM FIRE FIGHTING SYSTEM

This is a continuation, of application Ser. No. 080,446 filed Oct. 1, 1979, now abandoned.

BACKGROUND OF THE INVENTION

1. Field Of The Invention

This invention relates to the use of foam for preventing and extinguishing fires and, more particularly, to a method and apparatus in which a halogenated hydrocarbon such as trifluorobromomethane ($CF_3Br$) is used to create a fire-fighting foam or is added as a gas to the bubbles of a fire-fighting foam.

2. Description Of The Prior Art

Over the years, a number of techniques using foams have been used for extinguishing fires, particularly those involving gasoline and other volatile substances. Because of their many advantages, Aqueous Film Forming Foam (AFFF) systems are widely used in fighting fires. AFFF systems are effective in use because they contain a surfactant to reduce the surface tension of aqueous solutions to such a degree that the solutions will wet and spread upon non-polar and water immiscible solvents even though such solvents are lighter than water; they form a fuel or solvent vapor barrier which will rapidly extinguish flames and prevent reignition and reflash. Examples of compositions useful in AFFF systems are taught in the prior art by P. J. Chiesa, Jr. in U.S. Pat. Nos. 3,849,315 and 4,038,195; by R. A. Falk in U.S. Pat. No. 4,042,522; and R. Bertocchio in U.S. Pat. No. 4,069,158; and by others.

One of the problems of prior art foam systems, including the AFFF systems, is that as the foam breaks down due to the heat and other effects of a fire, air is released from the foam bubbles as they break down. The air, of course, serves to negate the extinguishing effects of the foam by feeding the fire.

To overcome this disadvantage it has been proposed by R. L. McElroy et al, in U.S. Pat. No. 1,829,714, to use foam produced by a mixture of bicarbonate of soda and aluminum sulfate in water and other compounds such that a fire suppressing gas is released when the foam breaks down. In the prior art also R. L. Tuve et al. have addressed the problem by covering the fire with a fire-extinguishing dry powder and thereafter covering the powder with a perfluorocarbon foam.

It was known, of course, to introduce a fire-inert gas or a compound producing such inert gas into the atmosphere surrounding a fire or potential fire to extinguish or prevent a fire. The first gases used in the technique, such as carbon dioxide, operate primarily to deny the fire sufficient oxygen to support combustion. Other effects of the technique are to dilute flammable vapors and to cool flammable vapor/air mixtures. It has been found that volatile fluorohalocarbons containing bromine, such as $CF_3Br$, $C\ Br\ ClF_2$, $C\ Br_2F_2$, and $C\ F_2Br$-$CF_2Br$, are strikingly more effective in extinguishing a fire than are the older fire-inert gases. Because of the great efficacy of $CF_3Br$ (marketed commercially as Halon 1301 by E. I. DuPont de Nemours and Company, Wilmington, Delaware), it has been postulated that compounds of this class, instead of smothering a fire, extinguish it by capturing free-radicals thus terminating flame reactions. Even though they demonstrate a marked superiority over the compounds producing the older fire-inert gases, the bromine-containing fluorocarbons are only slowly finding a market because of their relatively high cost when used in accordance with conventional practice.

In spite of the clear advantages of the compounds of this class in terminating flame reactions, the prior art produces no teachings of their use in a foam fire-extinguishing system. There is a teaching; however, by C. Herbline, in U.S. Pat. No. 3,529,670, of the use of a fluorohalocarbon, chlorobromodifluoromethane, in a fire-extinguishing system to pressurize a liquid such as water or oil such that the liquid can thereby be propelled from its container and on to a fire, the release of pressure upon leaving the container turning the propelled mixture into heavily halogenated icicles or snow. It will be seen, therefore, that the disclosure of C. Herbline concerns itself with a fire-fighting system employing a projected solid rather than a foam as is the case in the present invention.

SUMMARY OF THE INVENTION

Various foam systems are widely used in fighting or preventing fires. In these systems, the fluid, such as AFFF compound, expands 10 to 1 in the dispensing nozzle, aspirating air when so doing to thereby form the foam bubbles. Foam fire fighting systems in use today typically employ a light water aqueous film-forming compound, a protein compound, or the like, to produce the foam. My invention is based on the discovery that the addition of a proportional amount of a halogenated hydrocarbon compound such as Halon 1301 ($CF_3Br$) into the foam projecting apparatus itself results in the fire extinguishing compound being added as a gas into each of the air bubbles of the air-aspirated foam. For convenience of exposition, the halogenated hydrocarbon compound will be referred to herein as a halogen. This addition of the compound to the foam not only increases the fire fighting ability of the foam as described herein previously, but increases the expansion rate of the foam and, in addition, increases the distance the foam is projected by the apparatus to thereby achieve greater coverage and greater penetration of the foam into the fire. Moreover, I have also found that the injection of the halogenated gas into the fire-fighting liquid produces a foam in the hose or pipe line, the bubbles of foam containing substantially only halogen, even with a plain, smooth bore hose nozzle. Inasmuch as conventional foam-generating nozzles utilize an orifice plate or other means acting on the flow to generate a foam, the ability of the technique of this invention to produce a foam with a plain nozzle means that the nozzle presents a minimum obstruction to the flow therethrough. This factor as well as the greater inertia of the foam because the halogen is heavier than air plus the increase in volume resulting when the compound-laden flow expands through the nozzle results in a significant increase in the projection range of the apparatus.

It is thus a principle object of the invention to provide a method and apparatus for use with foam-type fire fighting equipment by which a halogenated hydrocarbon compound can be injected into the bubbles of the foam projected by the equipment such that the breakdown of the bubbles in the fire introduces a fire-fighting agent therein that enhances the effectiveness of the foam.

It is another object of the invention to provide means for use with foam-type fire fighting systems that increases the expansion rate of the bubbles in the foam and the distance the foam is projected such that the range and coverage of the system is enhanced thereby.

A further object of the invention is to provide an uncomplicated, practical, inexpensive means for employing halogens such as bromine-containing fluorocarbons to fight or prevent fires.

Yet another object of the invention is to provide means by which a foam useful in fighting fires can be produced with a plain, smooth bore hose nozzle to thereby avoid the performance and cost penalties associated with the use of conventional foam producing apparatus.

Still another object of the invention is to provide means for adding a gas that is heavier than air to the bubbles in a fire-fighting foam to increase its momentum to enable it to be projected to a greater range.

Still another object of the invention is to accomplish the foregoing objects in a practical, safe, reliable manner that will comply with all applicable current local, state, and federal regulations.

Other and further objects of the invention will be obvious upon an understanding of the illustrative embodiments about to be described, or will be indicated in the appended claims, and various advantages not referred to herein will occur to one skilled in the art upon employment of the invention in practice.

DESCRIPTION OF THE DRAWINGS

For the purpose of illustrating the invention, there is shown in the drawings the forms which are presently preferred; it should be understood, however, that the invention is not necessarily limited to the precise arrangements and instrumentalities shown.

DESCRIPTION OF THE PREFERRED EMBODIMENT

Figure 1:
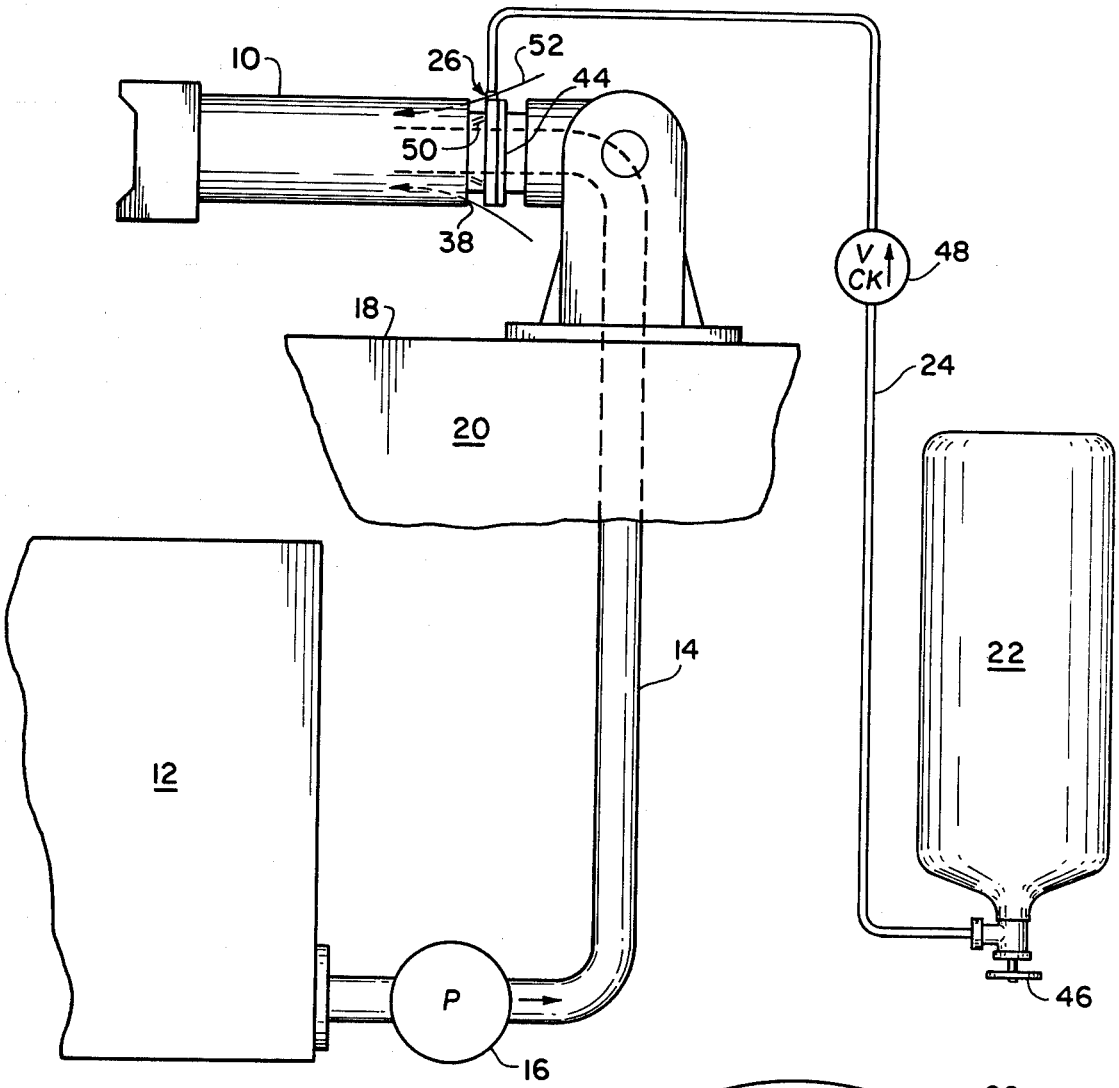
FIG. 1 is a schematic representation of a turret nozzle fire-fighting system embodying the halogen injection system of the invention.

Referring now to the drawings, particularly to FIG. 1, which illustrates the system of the invention embodied in mobile fire-fighting equipment. Mobile equipment typically includes a turret foam nozzle 10, a tank 12 containing the foam-type extinguishing fluid, piping 14 connecting the fluid tank with the turret nozzle, and a pump 16 in piping 14 for pumping the extinguishing fluid from the tank for delivery to the foam nozzle at the required flow rate and pressure. Typically, ancillary components such as relief valves, check valves, supply valves, drain valves, vents, and the like known components of a mobile system will also be provided but their function is well known and for the interests of brevity and clarity, they will not be shown nor described herein. Turret foam nozzle 10 is mounted at any suitable location on the vehicle such as upon the roof 18 of the cab 20 thereof. The fire-extinguishing compound dispensed as a foam out of the nozzle can be a AFFF compound, a protein compound, or any other well-known extinguishing agent in common use.

Figure 2:
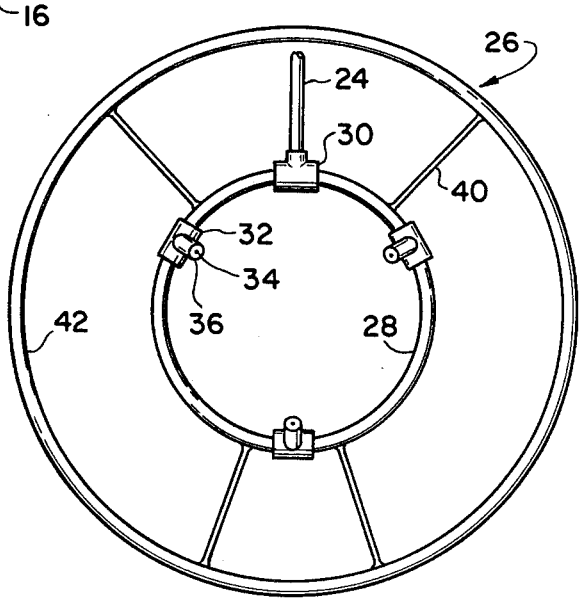
FIG. 2 is a front elevational view of the halogen injection means embodied in the system of FIG. 1.

It will be recognized that the equipment set forth in the foregoing description is representative of apparatus in common use. In this invention, a halogen such as a bromine-containing fluorocarbon, preferably $CF_3Br$, from a storage tank or supply receptacle 22 is passed through tubing 24 to a collar 26 on the turret nozzle 10 and is metered into the foam-forming compound flowing therethrough. The metering collar 26 comprises a ring-shaped tubular manifold 28 connected by means of a T-fitting 30 to the halogen supply tube 24 from the storage tank 22. Equally spaced around the manifold 28 are a plurality of metering nozzles 32 each having a suitably sized metering orifice 34 in the radially inward end 36 thereof (see FIG. 2). The manifold is fixedly positioned at the air induction opening 38 of the nozzle by means of radial rods 40 secured to a mounting ring 42 which is suitably fixed on the breech 44 of the nozzle. The halogen system will be provided with the elements usually present in fluid supply equipment such as a shut-off valve 46 on the storage tank 22, a check valve 48 in tubing 24 and the like.

In operation, as is the usual practice in mobile apparatus, the operation of the foam dispensing system including such functions as the opening of the necessary valves, the initiation of pumping, the pointing of the turret nozzle, is controlled remotely by an operator at a control station or console. It will be appreciated that shut-off valve 46 can be coupled into the automatic control system to permit the remote operation thereof. At the scene, therefore, the operator will initiate pumping to establish a stream of foam out of nozzle 10 which is directed at the fire or other area of interest. At that time or thereafter as desired, the shut-off valve 46 is opened and a flow of halogen under storage pressure will be delivered to the metering collar 26 via tubing 24. Halogens such as $CF_3Br$ are normally stored in a pressure vessel at a saturated vapor pressure that is typically 200 pounds per square inch gauge at 75° F. At the collar, the halogen is sprayed, as indicated at 50, through the metering orifices 34 at a rate of 15 pounds of compound per 250 gallons of extinguishing agent per minute into air (indicated by arrows 52) induced into air induction opening 38 of the nozzle 10. This halogen-laden air mixes with the extinguishing agent passing through the nozzle to form a foam having halogen in the bubbles thereof.

Figure 3:
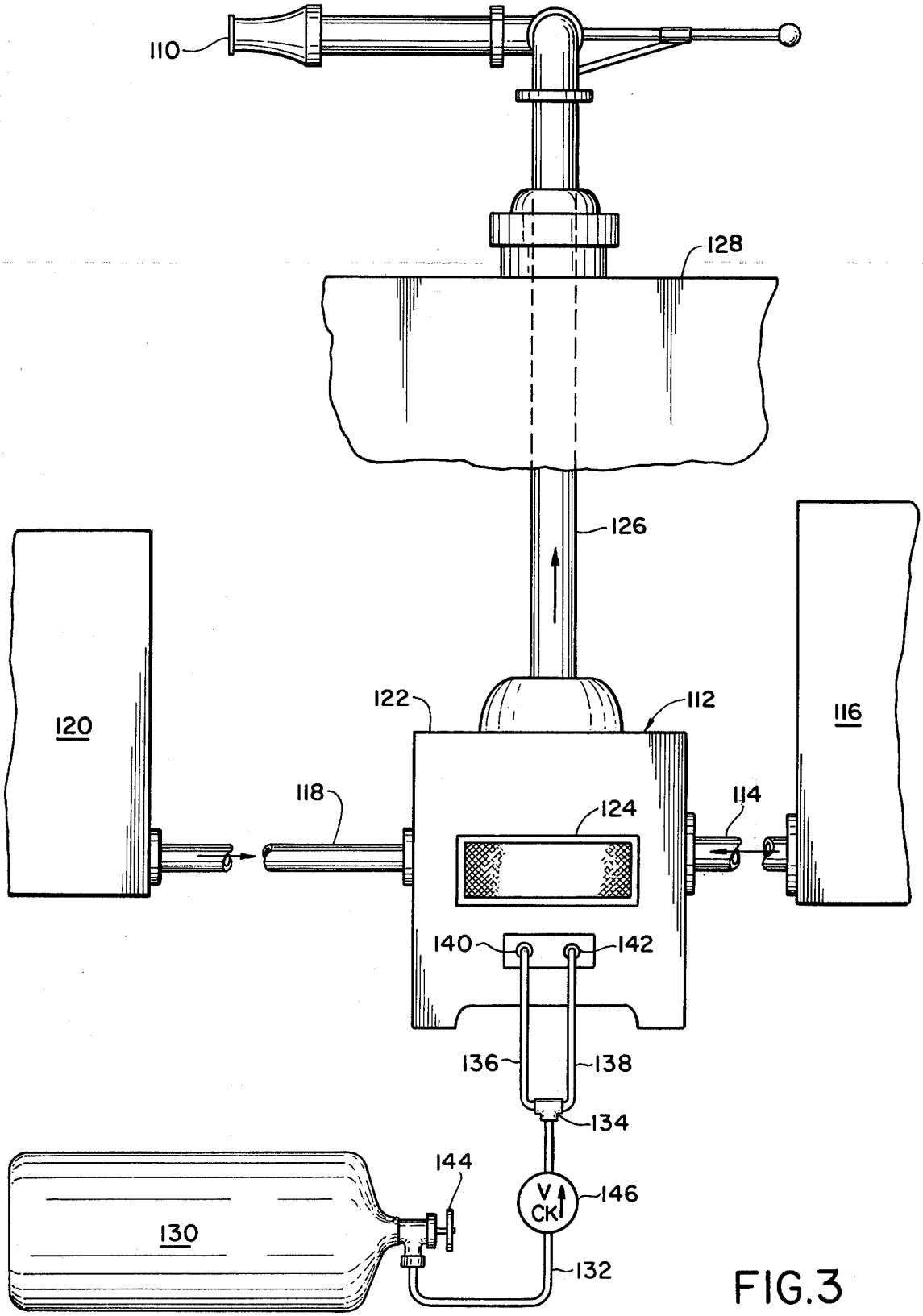
FIG. 3 is a schematic representation of a fire fighting foam-pumping system embodying the halogen injection system of the invention.

A further embodiment of the invention for entraining a halogen into a foam system is illustrated in FIG. 3. Unlike the FIG. 1 embodiment in which the foam is generated in the turret foam nozzle 10 of the system, in the FIG. 3 embodiment a plain nozzle 110 is provided and the foam is generated for delivery therethrough by a foam pump system 112. Foam-pumping systems are in everyday use and it thus is believed that it would serve no useful purpose to provide a detailed description herein. Suffice it to say; however, that in a typical system, water from pipe 114 connected to water supply tank 116 and light water or other suitable foam liquid from pipe 118 connected to supply tank 120 is mixed in an appropriate mixing chamber in the foam-pumping apparatus 122 with air induced through a screened opening 124 and the resulting foam is pumped through pipe 126 to the nozzle 110 to be projected therefrom. Because the foam is generated in apparatus 122, the nozzle 110 can be a plain nozzle and can be of the monitor type mounted on the floor or deck 128 of the vehicle (not shown).

The foregoing will be recognized to be a description of a conventional foam pump system. My invention is embodied therein by the provision of a halogen system comprising a halogen storage tank 130 from which halogen under storage pressure is passed through tubing 132 to a T-fitting 134 and from thence through tubes 136 and 138 to metering nozzles 140 and 142 respectively opening into the foam-mixing chamber in the foam-pumping apparatus 122. The halogen system will be provided with the usual shut-off valve 144 on the storage tank 130, a check valve 146 in tubing 132, and the like elements of a fluid supply system.

In operation, when the mobile equipment reaches the scene of operations, the operator aims the monitor nozzle 110 and the pump of the foam pump system will be turned on in the conventional way to produce a stream of foam that is projected out of the nozzle. At the same time the foam pump system is turned on to begin delivery of foam to the nozzle or when desired thereafter the shut-off valve 144 is opened. A flow of halogen, which typically is contained in tank 130 at a saturated vapor pressure of 200 psig at 75° F., passes through the associated tubing 132, 136, and 138 and is sprayed at a rate of 15 lbs. of compound per 250 gals. of extinguishing agent through the metering nozzles 140 and 142 into the foam mixing chamber of the pumping apparatus 122. There the halogen mixes with the foam being generated such that when the foam is projected out of nozzle 110, the halogen is entrained in the bubbles of the foam and is carried therewith to the area being foamed.

Figure 4:
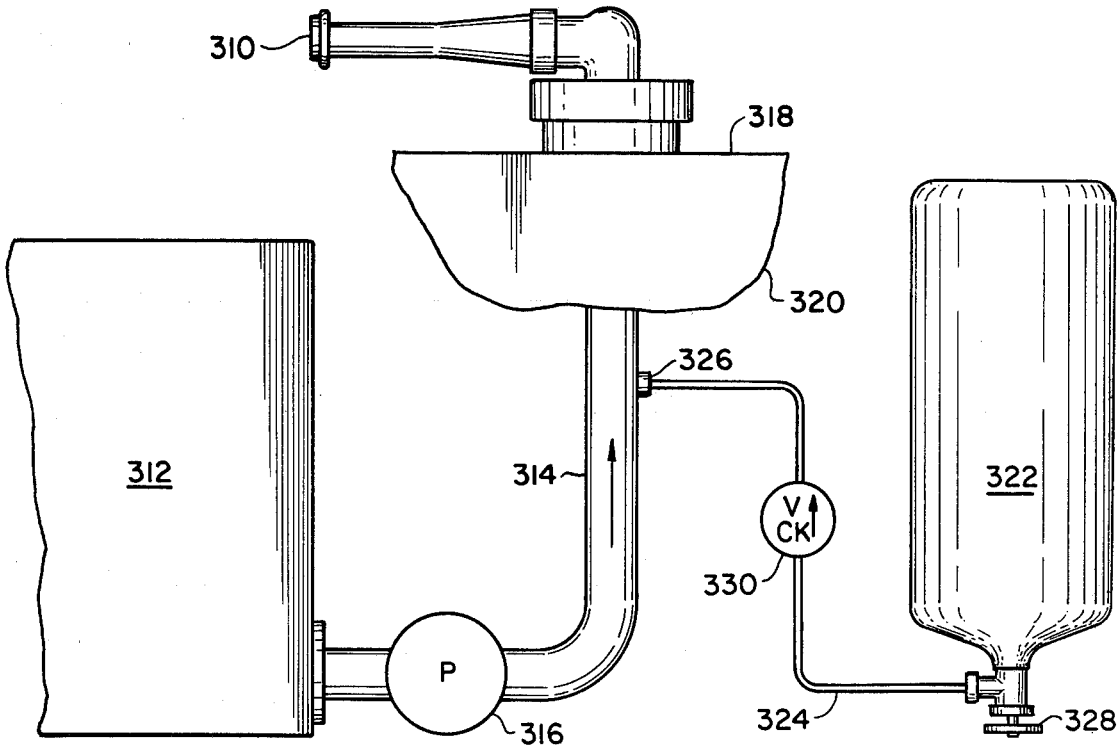
FIG. 4 is a schematic representation of an alternate turret nozzle fire-fighting system embodying the halogen injection system of the invention.

In the embodiments of the invention just described, a halogen is mixed into foam being generated in a foam nozzle or in a foam generating pump system. I have discovered, however, that it is possible to produce a foam out of a standard water nozzle and without a foam generating pump system or a foam nozzle simply by injecting a halogen into light water or other extinguishing liquid being piped to the plain nozzle. Thus, referring now to FIG. 4 illustrating a typical mobile unit including a plain turret nozzle 310, a tank 312 containing extinguishing liquid, piping 314 connecting the liquid tank with the nozzle, and a pump 316 in piping 314 for pumping the liquid from the tank for delivery out of the nozzle at a required flow rate and pressure. As stated in the description of the FIG. 1 embodiment, the system will have the usual ancillary components of mobile fire-fighting apparatus. Turret nozzle 310 is mounted at any suitable location on the vehicle such as upon the roof 318 of the cab 320 thereof.

The halogen system of this invention comprises a pressure vessel or storage tank 322 from which halogen is passed through tubing 324 to a metering nozzle 326 opening into the interior of liquid pipe 314. The usual elements present in fluid supply equipment such as a shut-off valve 328 on tank 322, and a check valve 330 in tubing 324, and the like elements in common use can be provided as required. Also, if desired, the shut-off valve 328 can be connected in a well-known way into the remote control system of the mobile apparatus by suitable means not shown so that the halogen feed system can be activated remotely from a control station by an operator when the pump 316 is turned on.

In operation, the shut-off valve 328 is opened to initiate a flow of halogen through tubing 324 and into the liquid supply pipe 314 through metering nozzle 326 and the pump 316 is engaged. The metering orifice of nozzle 326 is sized to meter the halogen at storage pressure into the liquid at a rate of 0.060 lbs. of compound per gallon of extinguishing liquid per minute. As the liquid with the halogen entrained therein passes out the nozzle, a foam whose bubbles are substantially filled with halogen is produced. It is believed that the phenomenon involved is that the release from confinement of the halogen liquid mixture enables the halogen to expand and thereby produce a foam. It is also believed that this increase in volume of the halogen in changing phase as well as the increase in the inertia of the foam because the halogen is heavier than air also act to produce the significant increase brought about by this invention in the distance the stream of foam is projected by the nozzle, thereby enhancing the safety aspects and efficiency of the operation.

Figure 5:
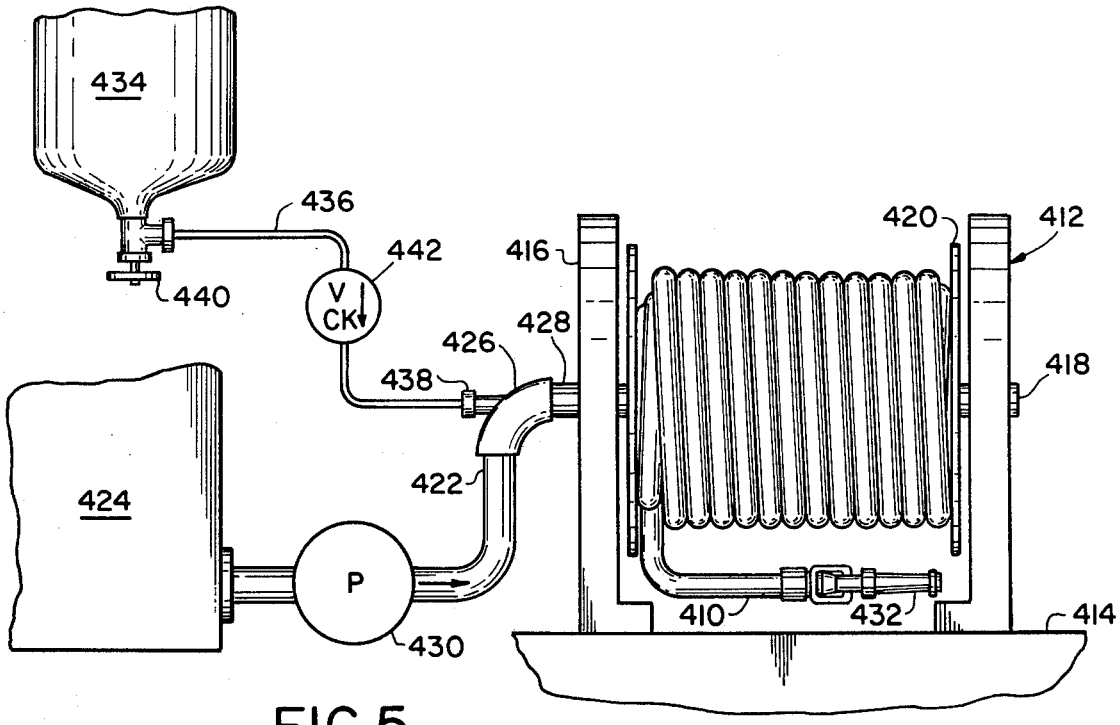
FIG. 5 is a schematic representation of the halogen injection system of the invention embodied in a hose line fire-fighting system.

FIG. 5 illustrates the halogen system of this invention embodied in a conventional hose or hand line 410 stowed on a reel 412. The reel, which is suitably mounted on a floor or deck 414, comprises a framework 416 having a shaft 418 mounting a spool 420 for rotation such that the hose 410 can be unwound or wound thereon for stowage. FIG. 5 shows the hose wound on the spool in the stowed position. Reel 412 is of the continuous-flow type in which the piping 422 from the supply tank 424 is connected to a swivel joint inlet 426 which, in turn, passes through the reel hub 428 and is connected to the reel end of hose 410 by an outlet riser (not shown) such that the extinguishing liquid can be dispensed through the hose even though it is partially or even wholly wound on the reel. A conventional pump 430 is provided in pipe 422 to supply the extinguishing liquid to the plain nozzle 432 at the required flow rate and pressure. It should be mentioned that, when reference is made herein to a "plain" nozzle, the designation is intended to indicate that the nozzle can be of the plain straight or tapered bore type and need not be provided with mechanical means to create a foam.

The halogen system in this embodiment comprises a storage tank 434 from which halogen is passed through tubing 436 to a metering nozzle 438 opening into the flow passing through the swivel joint inlet 426. The usual shut-off valve 440 on tank 434 and a check valve 442 in tubing 436 and the like are provided.

In operation, the pump 430 will be actuated to prime the system and the hose will be deployed. The shut-off valve 440 is opened to initiate a flow of halogen through tubing 436 and through metering nozzle 438 into the swivel joint inlet 426 of the reel 412. The metering orifice of halogen nozzle 438 is sized to meter the halogen at storage pressure into the extinguishing liquid at a rate of 0.060 lbs. per gallon of liquid per minute. When the nozzleman opens the nozzle, a stream of foam will be projected therefrom.

It will be appreciated that in the FIG. 5 embodiment, the halogen nozzle 438 can be positioned in other locations in the hose line system such as at a hose coupling or even at the nozzle end itself. If required thereby, the tubing 436 can be of the flexible type such that the mobility of the installation is not unduly restricted.

Although shown and described in what are believed to be the most practical and preferred embodiments, it is apparent that departures from the specific methods and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

Having thus described my invention, what I claim is:

1. Apparatus for fighting fires comprising, in combination:

means for supplying an aqueous liquid under pressure to a discharge opening;

nozzle means at said discharge opening, said nozzle means having a discharge orifice and, upstream therefrom, an air induction opening around the periphery of said nozzle means;

metering means supported around said air induction opening, said metering means comprising an annular metering collar having spaced around the annulus thereof a plurality of metering nozzles whose output is directed into said air induction opening, said metering means passing a trifluorobromomethane ($CF_3Br$) compound from a supply receptacle under pressure into said aqueous liquid such that said mixed liquid and said compound are projected as a foam onto a fire from said nozzle means, the trifluorobromomethane compound mixed in said liquid expanding upon passage through said nozzle means to generate a gas in the bubbles of said foam whereby said compound is carried in said bubbles to said fire by said foam such that the subsequent bursting of said bubbles releases said compound to act on said fire and thereby further the fire extinguishing action of said foam.

* * * * *